US009163636B2

(12) United States Patent
Kim

(10) Patent No.: US 9,163,636 B2
(45) Date of Patent: Oct. 20, 2015

(54) PROTECTION STRUCTURE OF MOTOR FOR COOLING-FAN

(71) Applicants: Hyundai Motor Company, Seoul (KR); Kia Motors Corporation, Seoul (KR)

(72) Inventor: Kyung-Tae Kim, Whasung-Si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 298 days.

(21) Appl. No.: 13/751,964

(22) Filed: Jan. 28, 2013

(65) Prior Publication Data

US 2014/0112809 A1 Apr. 24, 2014

(30) Foreign Application Priority Data

Oct. 19, 2012 (KR) ..... 10-2012-116591

(51) Int. Cl.

*F04D 25/06* (2006.01)
*F04D 19/00* (2006.01)
*F04D 27/00* (2006.01)

(52) U.S. Cl.

CPC ..... *F04D 25/0606* (2013.01); *F04D 19/002* (2013.01); *F04D 25/06* (2013.01); *F04D 27/008* (2013.01)

(58) Field of Classification Search

CPC ... F04D 29/263; F04D 29/329; F04D 29/526; F04D 29/703; F04D 25/06; F04D 27/008; F04D 19/002; F04D 25/0606

USPC ..... 417/319, 423.4, 423.7, 423.15

See application file for complete search history.

(56) References Cited

U.S. PATENT DOCUMENTS

| | | | | |
|---|---|---|---|---|
| 3,993,415 | A * | 11/1976 | Hauser | 416/93 R |
| 5,871,335 | A * | 2/1999 | Bartlett | 416/244 R |
| 7,585,159 | B2 * | 9/2009 | Caplan et al. | 417/368 |
| 2002/0195069 | A1 * | 12/2002 | Herke et al. | 123/41.49 |

FOREIGN PATENT DOCUMENTS

| | | | |
|---|---|---|---|
| JP | 2005-151766 | A | 6/2005 |
| KR | 2002-0019765 | A | 3/2002 |
| KR | 10-2009-0009396 | A | 1/2009 |
| KR | 10-2012-0025267 | A | 3/2012 |

* cited by examiner

*Primary Examiner* — Charles Freay
*Assistant Examiner* — Kenneth J Hansen
(74) *Attorney, Agent, or Firm* — Morgan, Lewis & Bockius LLP

(57) ABSTRACT

A protection structure of a motor for a cooling fan include a motor to which power source wire is connected for receiving electricity and a hub that is coupled to the motor and rotates. The hub includes: an outer portion along an outer peripheral surface of which blades are formed and on a center of which a center hole is formed; a center portion which is disposed at a middle of the center hole and to which is a rotations shaft of the motor is coupled; and a support member that couples the outer portion and the center portion. The support member is fractured physically to prevent overload to the motor and fire in advance. Furthermore, the power source wire is configured via the support member and thus is broken together when the support member is fractured to prevent unnecessary rotation of the motor.

4 Claims, 3 Drawing Sheets

PROTECTION STRUCTURE OF MOTOR FOR COOLING-FAN

CROSS-REFERENCE TO RELATED APPLICATION

The present application claims priority of Korean Patent Application Number 10-2012-116591 filed Oct. 19, 2012, the entire contents of which application is incorporated herein for all purposes by this reference.

BACKGROUND OF INVENTION

1. Field of Invention

The present disclosure relates to a protection structure of a motor for a cooling-fan, and more particularly, to a protection structure of a motor for a cooling-fan, capable of protecting a motor by fracturing parts between a power source wire for applying power to the motor, blade and the motor when a restriction (between shroud) is occurred.

2. Description of Related Art

Generally, a radiator of a vehicle for cooling cooling-water heated in an engine vehicle is arranged at a front part of the vehicle to be cooled by a traveling-wind and further is provided with a plurality of wrinkles or cooling fins to have larger radiation area.

A cooling fan of the radiator increases cooling effect by forced ventilation through a rotation of a blade and is coupled to an engine with a pulley (fan belt type) for operation or is operated through a driving of an electric motor.

The cooling fan operated by the driving of the motor has been widely in a Front engine Front-wheel driving (FF) vehicle wherein it is operated in such a manner that a controller applies power to a motor when the cooling water is at a predetermined temperature or more.

Since the cooling fan using a motor can be arranged easily and operated promptly without warming and, prevent engine power loss without a coupling to a pulley, the cooling fan using a motor is used more widely than the fooling fan of a fan-belt type.

However, when the motor is restricted to be rotated while power source is applied thereto, fire may occur due to over load. Furthermore, there is a need to protect a motor of the cooling fan since the cooling fan is coupled to a radiator and disposed on a front part of a vehicle.

In more detail, as show in FIG. 1, a gap between a shroud and a blade is maintained at a range of 3-4 mm so that air is guided to be input smoothly. However, the blade is restricted to be rotated in case where snow or rain is infiltrated into the gap and frozen or foreign substance such as soil or stone are jammed therein.

The gap between the shroud and the blade may be increased in order to prevent the restriction but it may decrease wind amount.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention has been propose to solve the above drawbacks. Various aspects of the present invention provide for a protection structure of a motor for a cooling fan, capable of preventing fire due to overheat of the motor such that a gap between a shroud and a blade is kept properly, and thus when the motor is restricted to be rotated, power source is cut off physically or a restriction to the motor is released.

Various aspects of the present invention provide for a protection structure of a motor for a cooling fan including a motor to which power source wire is connected for receiving electricity and a hub that is coupled to the motor and rotates is provided wherein the hub comprises: an outer portion along an outer peripheral surface of which blades are formed and on a center of which a center hole is formed; a center portion which is disposed at a middle of the center hole and to which is a rotations shaft of the motor is coupled; and a support member that couples the outer portion and the center portion.

The power source wire may be coupled via the support member, for example, the power source wire may be attached to a surface of the support member or inserted therein.

A holding cap may be mounted to the hub so that the outer portion is prevented from being disengaged when the support member is fractured.

Furthermore, at least two support members may be formed as bar types between the center portion and the outer portion and they are arranged in a swirling type wherein a length of the support member is longer than a gap between an outer peripheral surface of the center portion and an inner peripheral surface of the outer portion.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
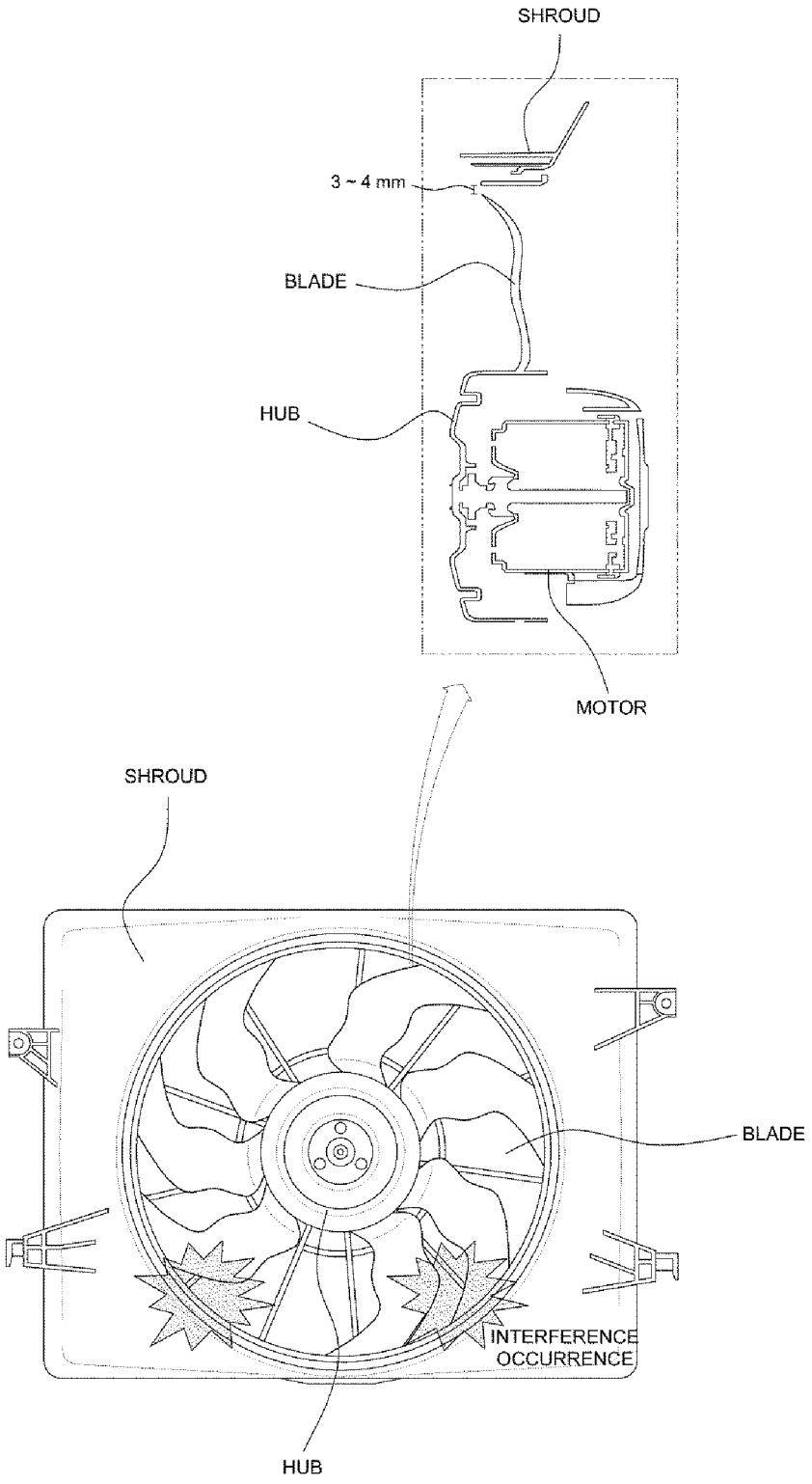
FIG. 1 (Prior Art)
FIG. 1 is a perspective view illustrating a cooling fan mounted to a radiator according to a related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Figure 2:
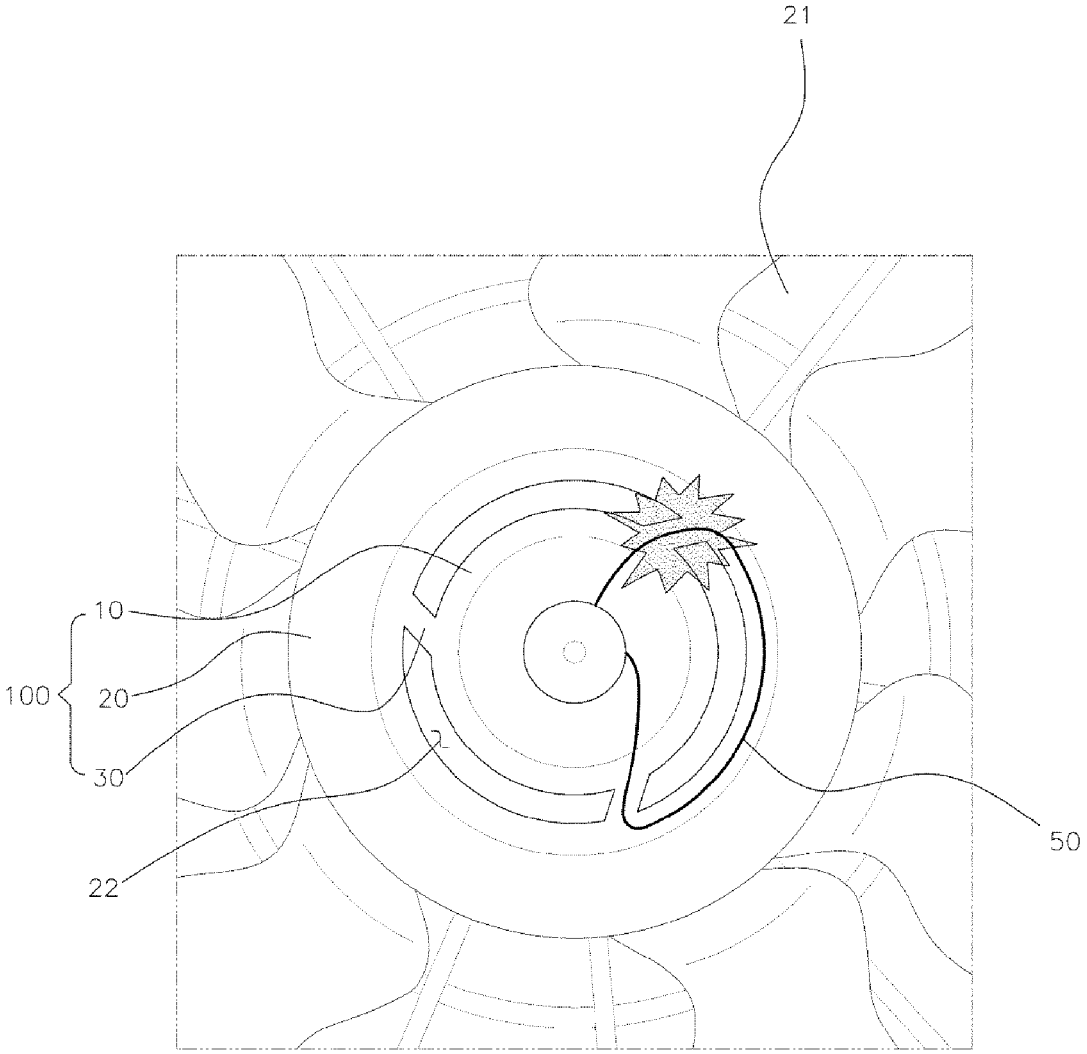
FIG. 2 is a perspective view illustrating an exemplary cooling fan according to the preset invention.
Figure 3:
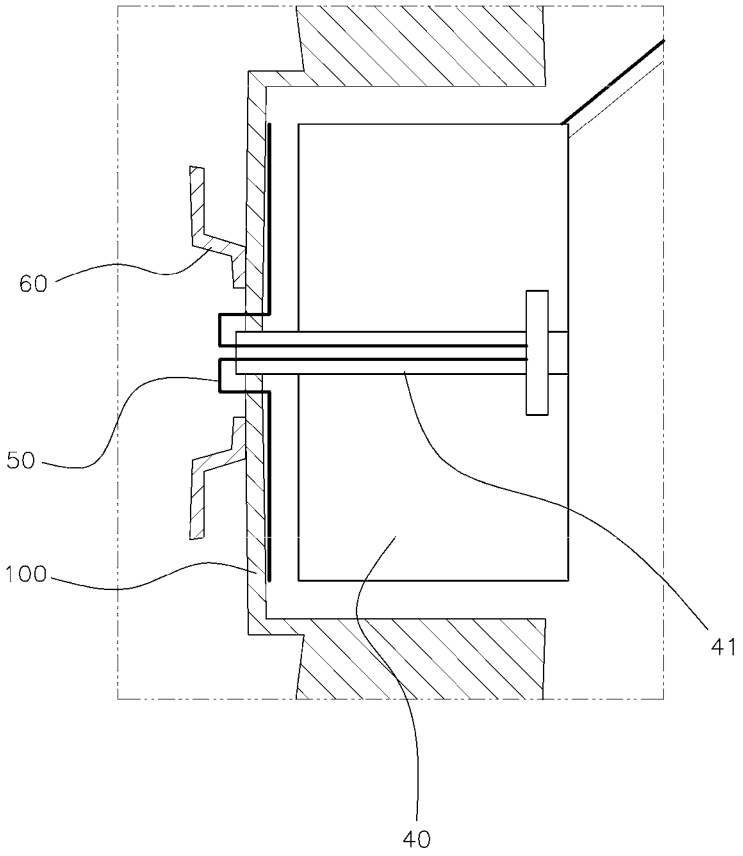
FIG. 3 is a perspective view illustrating an exemplary cooling fan provided a holding cap according to the present invention.

Referring to FIG. 2, a cooling fan according to the present invention includes a motor 40 to which power source wire is connected for receiving electricity and a hub 100 that is coupled to the motor and rotates.

The hub 100 according to the present invention a center portion 10 coupled to the motor 40, an outer portion on which a blade 21 is formed, and a support portion 30 coupling the center portion 10 and the outer portion 20.

Here, the blades 21 are formed along an outer peripheral surface of the outer portion 20 and a center hole 22 is formed in the middle of the outer portion. The center portion 10 is disposed in the middle of the center hole 22 and is coupled to a rotation shaft 42 of the motor 40.

The outer portion 20 and the center portion 10 are coupled through a support member 30. The support member 30 is fractured when the motor 40 is rotated while the blade is restricted to be rotated due to freezing or foreign substance jamming between the blade 21 and the shroud.

The support member 30 according to various embodiments of the present invention is configured as a bat shape, and at least two support members are formed between the center portion 10 and the outer portion 20*d* wherein a swirl wing type (that is, a wing shape of a swirl) and a length of the support member is longer than the gap between an outer peripheral surface of the center portion 10 and an inner peripheral surface of the outer portion 20.

Furthermore, after the support member 30 is fractured, the power source wire 40 for supplying power to the motor 40 passes via the support member 30, that is, it may be attached to a surface of the support member or be inserted into the support member 30, as shown in FIG. 2, in order to prevent unnecessary rotation of the motor 40.

Meanwhile, in the present invention, a holding cap 60 is provided to prevent disengagement of the outer portion 20 after the outer portion 20 is separated. The holding cap 60 is fabricated in a plate type to have a larger diameter than that of the center portion 10 and is fixed to the center portion (or shroud), and thus the outer portion 20 cab be prevented from being disengaged the support member 30 is fractured.

A protection structure of a motor for a cooling fan according to the present invention can protect the motor 40 by transferring excess load to the support member 30 of a coupling portion of the outer portion 20 and the center portion 10 and fracturing the support member and at the same time breaking the power source wire 50 when a restriction is occurred to the blade 21.

Furthermore, the support member 30 is broken at the moment when the restriction (collision state) is occurred while the blade (21) is rotated, and at this time the outer portion 20 may be disengaged due to inertia force but it can be prevented by the holding cap 60 according to the present invention.

According to the present invention, the support member is fractured physically to prevent overload to the motor and fire in advance.

Furthermore, the power source wire is configured via the support member and thus is broken together when the support member is fractured to prevent unnecessary rotation of the motor.

Further, a holding cap is provided to prevent the outer portion separated from the center portion from being disengaged. A plurality of the support members are provided as a swirling type and thus are fractured easily when pressure between the center portion and the outer portion is produced.

For convenience in explanation and accurate definition in the appended claims, the terms front and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A protection structure of a motor for a cooling fan comprising:

a motor;

a power source wire, wherein the motor is connected to the power source wire for receiving electricity; and a rotating hub coupled to the motor wherein the hub comprises:

an outer portion along an outer peripheral surface of the hub on which blades are formed and in a center of which a center hole is formed;

a center portion which is disposed at a middle of the center hole and coupled with a rotation shaft of the motor; and a support member coupling the outer portion and the center portion, and wherein the power source wire is coupled via the support member.

2. The protection structure of a motor for a cooling fan of claim 1, wherein a holding cap is mounted to the hub so that the outer portion is prevented from being disengaged when the support member is fractured.

3. The protection structure of a motor for a cooling fan of claim 1, wherein a holding cap is mounted to the hub so that the outer portion is prevented from being disengaged when the support member is fractured.

4. The protection structure of a motor for a cooling fan of claim 2, wherein at least two support members are formed as bar types between the center portion and the outer portion and they are arranged in a wing shape of a swirl wherein a length of the support member is longer than a gap between an outer peripheral surface of the center portion and an inner peripheral surface of the outer portion.

* * * * *